US011519052B2

(12) United States Patent
Hamide et al.

(10) Patent No.: US 11,519,052 B2
(45) Date of Patent: Dec. 6, 2022

(54) MAGNETIC COOLING ROLL

(71) Applicant: ArcelorMittal, Luxembourg (LU)

(72) Inventors: Makhlouf Hamide, Thionville (FR); Marc Anderhuber, Saulny (FR); Alain Daubigny, Audun le Roman (FR); Laurent Lutz, Hayange (FR)

(73) Assignee: ArcelorMittal, Luxembourg (LU)

( * ) Notice: Subject to any disclaimer, the term of this patent is extended or adjusted under 35 U.S.C. 154(b) by 0 days.

(21) Appl. No.: 17/273,466

(22) PCT Filed: Aug. 28, 2019

(86) PCT No.: PCT/IB2019/057256
§ 371 (c)(1),
(2) Date: Mar. 4, 2021

(87) PCT Pub. No.: WO2020/049418
PCT Pub. Date: Mar. 12, 2020

(65) Prior Publication Data

US 2021/0332455 A1 Oct. 28, 2021

(30) Foreign Application Priority Data

Sep. 7, 2018 (WO) ..... PCT/IB2018/056831

(51) Int. Cl.
*C21D 9/573* (2006.01)

(52) U.S. Cl.
CPC ..... *C21D 9/5737* (2013.01)

(58) Field of Classification Search
None
See application file for complete search history.

(56) References Cited

U.S. PATENT DOCUMENTS 4,993,478 A * 2/1991 George, II ..... B22D 11/0682 164/429
5,665,177 A 9/1997 Fukuno et al.
(Continued)

FOREIGN PATENT DOCUMENTS

JP S59217446 A 12/1984
JP S6199634 5/1986
(Continued)

OTHER PUBLICATIONS

Machine Translation of JP-04346628-A (Year: 1992).*
International Search Report of PCT/IB2019/057256, dated Nov. 25, 2019.

*Primary Examiner* — Keith Walker
*Assistant Examiner* — Ryan L Heckman
(74) *Attorney, Agent, or Firm* — Davidson, Davidson & Kappel, LLC

(57) ABSTRACT

A cooling roll including an axle and a sleeve, the sleeve having a length and a diameter and being structured as follows: an inner cylinder, a plurality of magnets disposed along at least a portion of the inner cylinder length, each magnet being defined by a width, a height and a length, a cooling system surrounding at least a portion of the plurality of magnets, the cooling system and the plurality of magnets being separated by a gap defined by a height, the gap height being the smallest distance between a magnet and the cooling system above, the magnets having a width such that the following formula is satisfied:

gap height×1.1≤magnet width≤gap height×8.6.

20 Claims, 6 Drawing Sheets

(56) References Cited

U.S. PATENT DOCUMENTS

| | | | | |
|---|---|---|---|---|
| 5,728,036 | A | 3/1998 | Kagan et al. | |
| 2010/0219567 | A1 * | 9/2010 | Imanari ..... | C21D 11/005 266/44 |

FOREIGN PATENT DOCUMENTS

| | | | | |
|---|---|---|---|---|
| JP | S639577 | Y2 | | 3/1988 |
| JP | 04346628 | A | * | 12/1992 |
| JP | H04346628 | A | | 12/1992 |
| JP | H05269549 | | | 10/1993 |
| JP | H0741978 | | | 2/1995 |
| JP | H1017184 | A | | 1/1998 |
| RU | 2175587 | C2 | | 11/2001 |
| SU | 427062 | A1 | | 5/1974 |
| SU | 688523 | A1 | | 9/1979 |
| WO | WO2013028925 | A1 | | 2/2013 |

* cited by examiner

MAGNETIC COOLING ROLL

The present invention relates to an equipment for cooling down a continuously moving metallic strip. This invention is particularly suited for the cooling of steel sheets, during metallurgical processes.

BACKGROUND

In a hot steel strip cooling process, cooling the strip with a cooling roll is a known process. Such cooling rolls can be used at various step of the process, e.g.: downstream a furnace or a coating bath. The strip is majorly cooled down due to the thermal conduction between the cooled cooling roll and the strip. However, the efficiency of such a technique is greatly impacted by the flatness of the strip and the surface contact between the roll and the strip. The strip flatness is worsened when there is a contact unevenness between the roll and the strip along the strip width due to uneven cooling rates.

Patent JPH04346628 relates to an apparatus, a roll, for cooling down a strip. Magnets are provided inside a roll body continuously or at suitable intervals. Over the magnets, there is one cooling tube wrapped helicoidally around the magnets, the cooling system. The outer shell of the roll is preferably coated with $Al_2O_3/ZrO_2$.

Patent JP59-217446 relates to an apparatus, a roll, for cooling or heating a metallic strip. The inside of the roll holds a heat carrier, the cooling system, while magnets are disposed in the outer shell of the roll.

SUMMARY OF THE INVENTION

However, by using the above equipment, the strip is not sufficiently in contact with to the roll in order to overcome the potential flatness defects of the strip and thus its flatness is worsened during the cooling and the quality of the strip is consequently degraded. Moreover, the cooling system does not permit to sufficiently and homogeneously cool the strip leading to temperature variations along the strip width, especially between the edges and the center of the strip. Furthermore, due to the arrangement of the different parts of the cooling roll, the heat transfer coefficient is not optimal.

Consequently, there is a need to find a way to reduce or suppress the contact unevenness between the roll and the strip in order to improve the contact homogeneity and thus the cooling homogeneity along the strip width. There is also a need to improve the efficiency of the cooling system.

It is an object of the present invention to provide a roll permitting to cool down a strip more homogeneously in its width direction without deteriorating the flatness of said strip.

The present invention provides a cooling roll (1) comprising an axle (2) and a sleeve (3), said sleeve having a length and a diameter comprising, from the inside to the outside:

an inner cylinder (4), a plurality of magnets (5) on the periphery of said inner cylinder disposed along at least a portion of the inner cylinder length, each magnet being defined by a width, a height and a length, a cooling system (6) surrounding at least a portion of said plurality of magnets (5), said cooling system and said plurality of magnets being separated by a gap (7) defined by a height, the gap height being the smallest distance between a magnet (5) and the cooling system above (6), said magnets (5) having a width such that the following formula is satisfied:

$$\text{gap height} \times 1.1 \leq \text{magnet width} \leq \text{gap height} \times 8.6.$$

The present invention also provides a method for cooling a continuously moving metallic strip, in an installation as described, comprising the steps of attracting magnetically a portion of said strip (15) to at least one cooling roll (1) and putting said strip (15) in contact with the at least one cooling roll (1).

Other characteristics and advantages of the invention will become apparent from the following detailed description of the invention.

BRIEF DESCRIPTION OF THE DRAWINGS

To illustrate the invention, various embodiments and trials of non-limiting examples will be described, particularly with reference to the following figures:

FIG. 2 shows an embodiment of a role where a supporting mean, an axle, is passed through.

DETAILED DESCRIPTION

Figure 1:
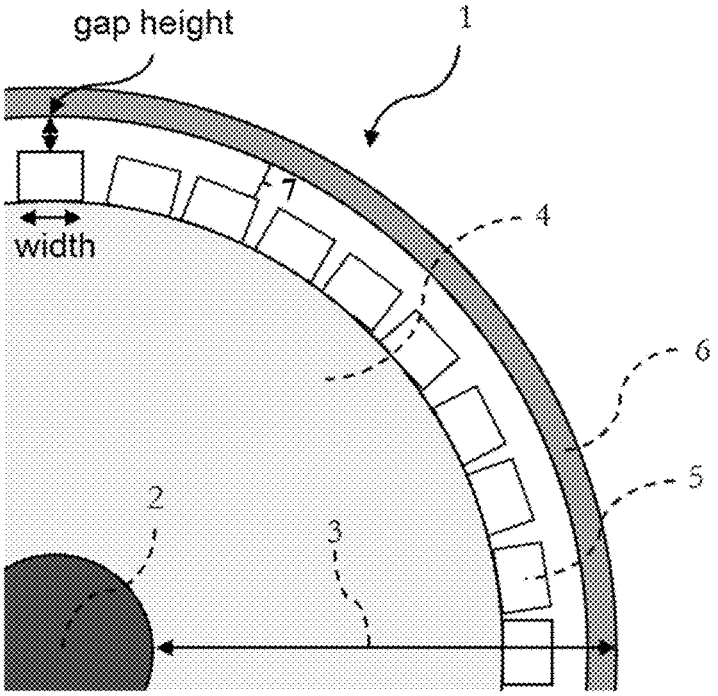
FIG. 1 is a cross section view of an embodiment of a roll showing a possible arrangement of the different elements.

As illustrated in FIG. 1, the invention relates to a cooling roll 1 comprising an axle 2 and a sleeve 3, said sleeve having a length and a diameter and being structured from the inside to the outside as follows:

an inner cylinder 4, a plurality of magnets 5 on the periphery of said inner cylinder disposed along at least a portion of the inner cylinder length, each magnet being defined by a width, a height and a length, a cooling system 6 surrounding at least a portion of said plurality of magnets 5, said cooling system and said plurality of magnets being separated by a gap 7 defined by a height, the gap height being the smallest distance between a magnet 5 and the cooling system above 6, said magnets 5 having a width such that the following formula is satisfied:

gap height×1.1≤magnet width≤gap height×8.6.

In the prior art, it seems that it is not possible to sufficiently attract the strip to the roll in order to overcome the flatness defects and obtain a homogeneous contact. This results in an even more uneven flatness and so a downgrade of the strip quality. Moreover, the arrangement of the cooling system does not permit to perform a sufficient and homogeneous cooling, failing to achieve the desired microstructure and properties.

On the contrary, with the equipment according to the present invention, it is possible to strongly and sufficiently attract the strip, overcoming the existing flatness defects. Thus, the strip is cooled down without engendering flatness defects or uneven properties. Moreover, the arrangement of the cooling system renders possible the production of a homogeneous cooling along the strip width.

Advantageously, said gap height satisfies the following formula:

gap height×1.4≤magnet width≤gap height×6.0.

It seems that respecting this formula allows to have at minimum 70% of the maximal attractive force.

Advantageously, said gap height satisfies the following formula:

gap height×1.6≤magnet width≤gap height×5.0.

It seems that respecting this formula allows to have at minimum 80% of the maximal attractive force.

Advantageously, said plurality of magnets is disposed along the whole inner cylinder length. Such an arrangement enhances the homogeneity of the cooling.

As illustrated in FIG. 1, the magnets are preferentially fixed to the inner cylinder 4, around its periphery.

Figure 2:
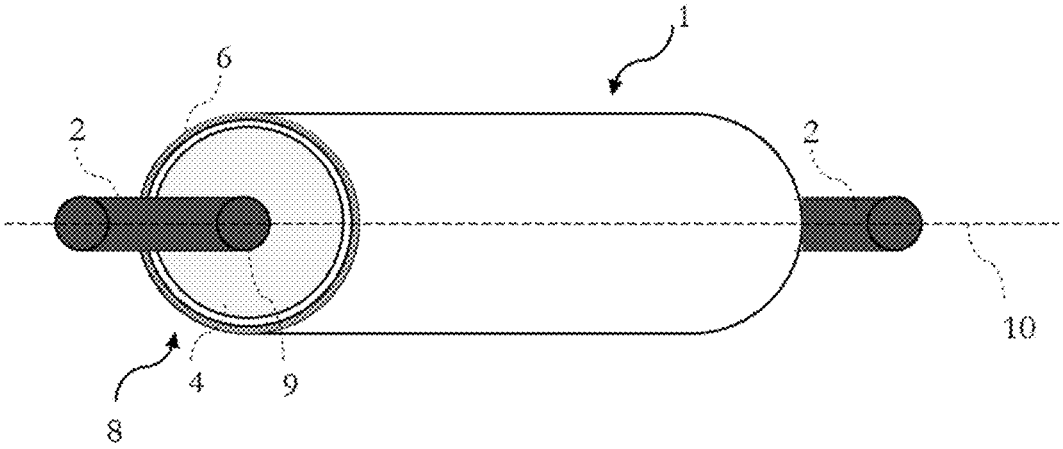

As illustrated in FIG. 2, the inner cylinder 4 preferentially comprises means for supporting, rotating and transporting the cooling roll, preferentially positioned on both lateral faces 8. Such means can be an axle 2 inserted inside holes 9 centered on the cylinder rotation axis 10 on both lateral faces 8. The cylindrical hole 9 can be from one lateral face to the other so the axle 2 passes through the cylinder.

Figure 3:
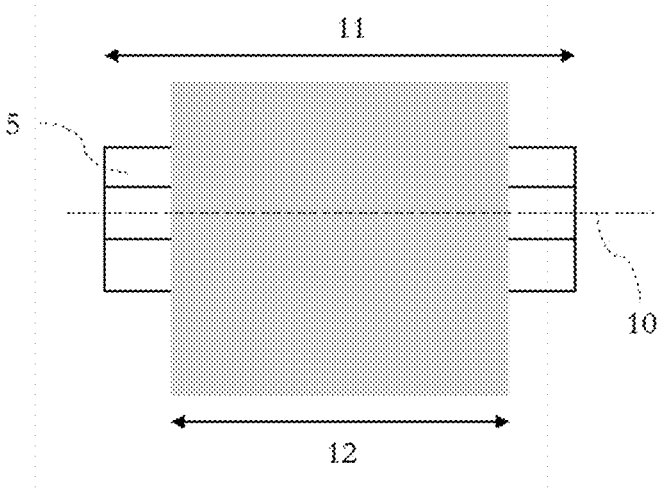
FIG. 3 exhibits a preferred magnet length compared to the strip width.

As illustrated in FIG. 3, the magnets 5 are preferentially arranged parallel to the roll rotation axis 10. Even more preferentially, each magnet length 11 is bigger than the strip width 12. Such disposition seems to increase the uniformity of the strip attraction to the cooling roll.

Figure 4:
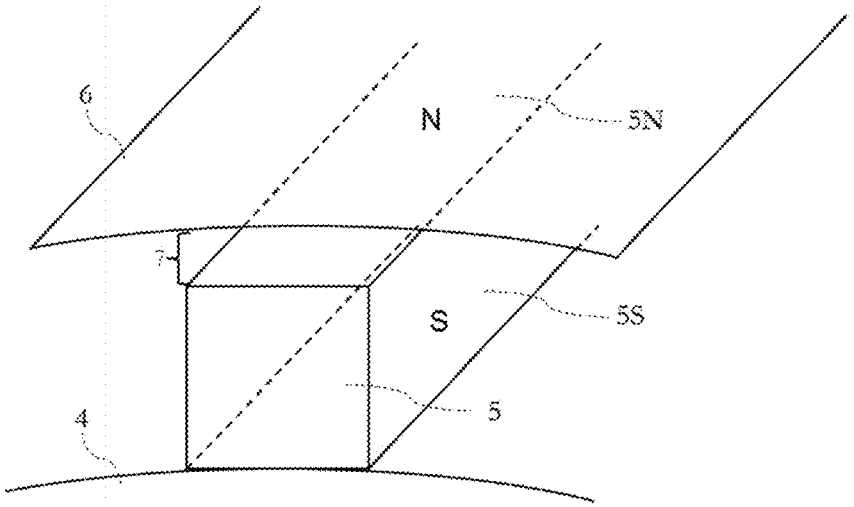
FIG. 4 shows the poles of a magnet.

As illustrated in FIG. 4, the north pole faces the cooling system 6, while the south pole faces the inner cylinder 4. The magnet height can be defined as the distance between the north face 5N and the south face 5S.

Advantageously, said magnets are permanent magnets. The use of permanent magnets permits to create a magnetic field without requiring wires or current, easing the management of the cooling roll. Moreover, it seems that the permanent magnets create a stronger magnetic field compared to electro-magnets. Furthermore, electro-magnets while in use generate an inductive current heating the roll and the coolant which seems to lower the cooling efficiency. Said magnets can be made of a Neodymium based alloy, NdFeB for example.

Figure 5:
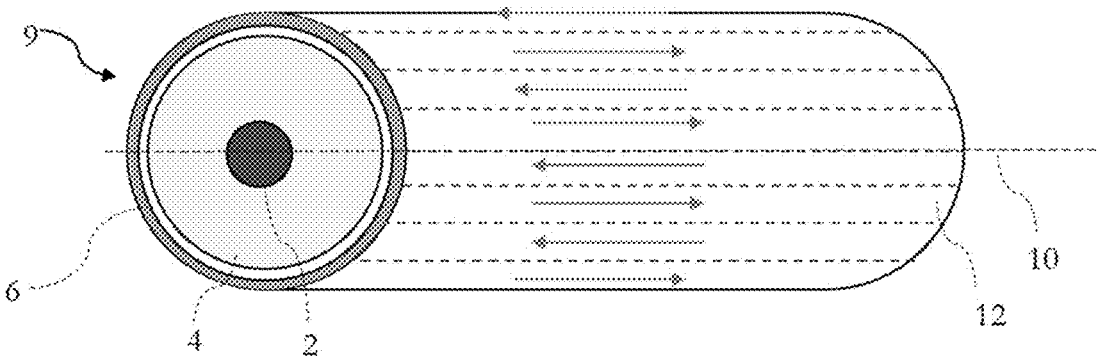
FIG. 5 exhibits a preferred orientation of the cooling flows through the cooling channels.

Advantageously, as illustrated in FIG. 5, said cooling system 6 is made of a metallic layer comprising at least two cooling channels 12 through which a coolant can be flowed. Preferably, said cooling system has a hollow cylindrical shape. It is preferable to have several cooling channels because the coolant can be easily and more often renewed leading to a lower coolant temperature compared to a single compartment. The cooling system 6 is preferentially a ferrule containing a coolant. Preferentially, the cooling system covers at least the whole width of the passing strip being cooled and even more preferentially. It permits to increase the homogeneity of the cooling along the width strip.

Advantageously, as illustrated in FIG. 5, said cooling channels 12 are disposed parallel to the roll rotation axis 10. Apparently, such a positioning of the cooling channels permits to shorten the cooling length of a channel so the coolant temperature at the end of the channel is lower than if the cooling channel was crooked. It enhances the coolant efficiency.

Figure 6:
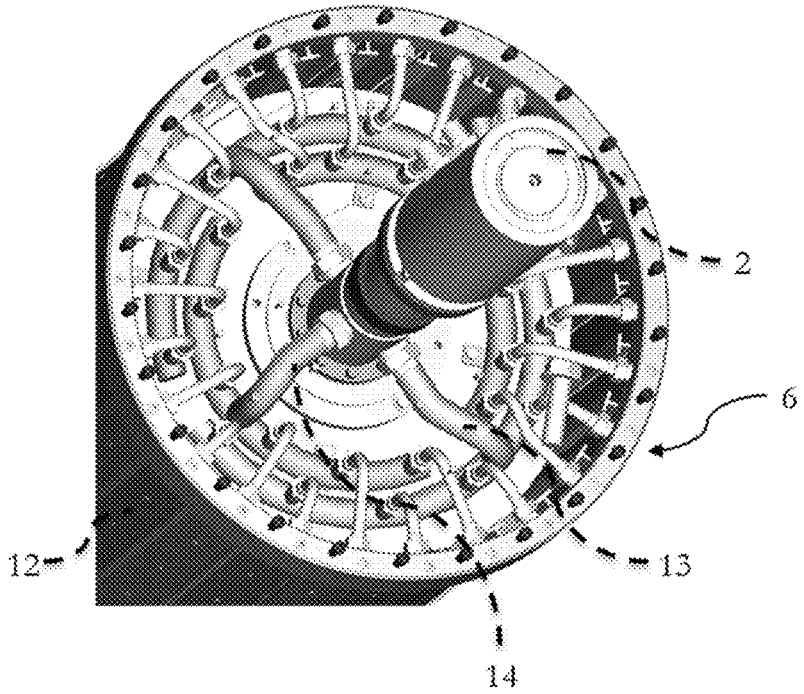
FIG. 6 shows a possible arrangement of the supporting means, the cooling systems and means to connect them.
Figure 7:
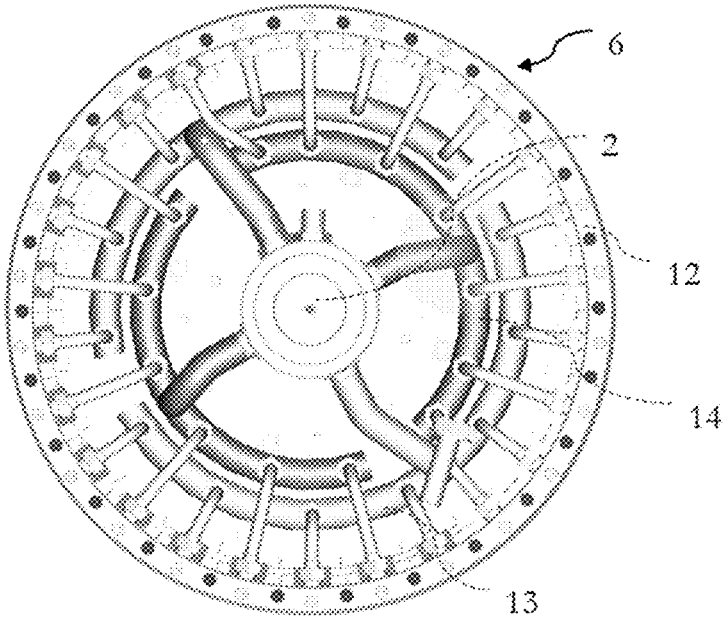
FIG. 7 exhibits a second possible arrangement of the supporting means, the cooling systems and means to connect them.

Advantageously, as illustrated in FIGS. 6 and 7, the cooling system 6 comprises means for injecting a coolant 13 in said cooling channels 12. Preferentially, the means for injecting a coolant 13 are connected to at least a support of the roll 2, wherein the coolant can be flowed so the coolant passes from a system permitting to continuously cool down the coolant (not represented) to the cooling channels 12 by the at least one support 2 and the means 13 for injecting a coolant. The cooling system 6 also comprises retrieving means 14 for flowing the coolant from the cooling channel 12 back to a system permitting to continuously cool down the coolant. Consequently, the coolant is preferably flowed in a closed circuit.

Advantageously, as illustrated in FIGS. 6 and 7, the means 13 for injecting a coolant are alternatively disposed on both sides of the cooling channels 12. As illustrated in FIG. 7, the cooling channels 12 are connected alternatively to an injector 13 or a return 14. This alternation enhances the cooling uniformity because the cooling flow direction of adjacent channels is opposite.

Advantageously, said cooling system surrounds said plurality of magnets. Such an arrangement enhances the homogeneity and performance of the cooling.

Advantageously, as illustrated in FIG. 5, the coolant in said cooling channels flows in opposite direction in adjacent cooling channels. Such a cooling method enables a more homogeneous cooling along the strip width.

Figure 8:
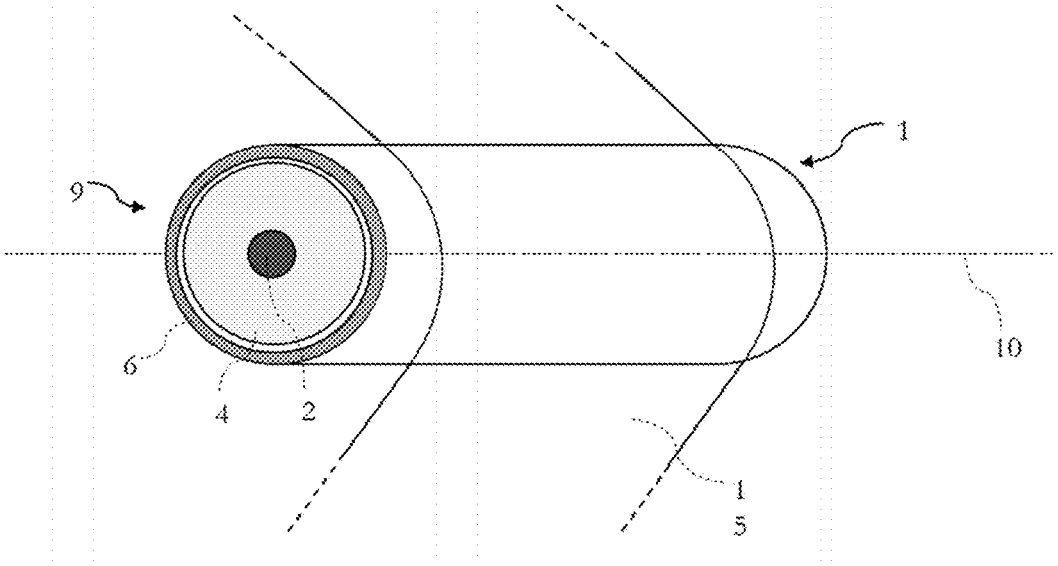
FIG. 8 shows a possible position of the strip on the cooling roll.

As illustrated in FIG. 8, the invention also relates to a method for cooling a continuously moving strip 15, in an installation according to the invention, comprising the steps of attracting magnetically a portion of said strip to at least one cooling roll 1 and putting said strip 15 in contact with the at least a cooling roll 1.

Such a method combined with the equipment previously described permits to strongly and sufficiently attract the passing strip overcoming the existing flatness defects. Thus, the passing strip is cooled down without engendering flatness defects or uneven properties.

Advantageously, at least three cooling rolls are being used and said strip is in contact with the at least three cooling rolls at the same time. Such a use of several rolls enables a good cooling along the strip.

Advantageously, said strip in contact with the cooling roll has a speed comprised between 0.3 $m.s^{-1}$ and 20 $m.s^{-1}$. It seems that because the heat transfer coefficient is increased, the strip needs less time contact on the roll to achieve the desired temperature hence the possibility to work with higher roll speed rotation.

The following description will concern two uses of the invention in different installations for the cooling of a strip using cooling rolls. But, the present invention is applicable to every process where a metallic strip is cooled e.g. in the finishing, galvanisation, packaging or annealing lines.

Figure 9:
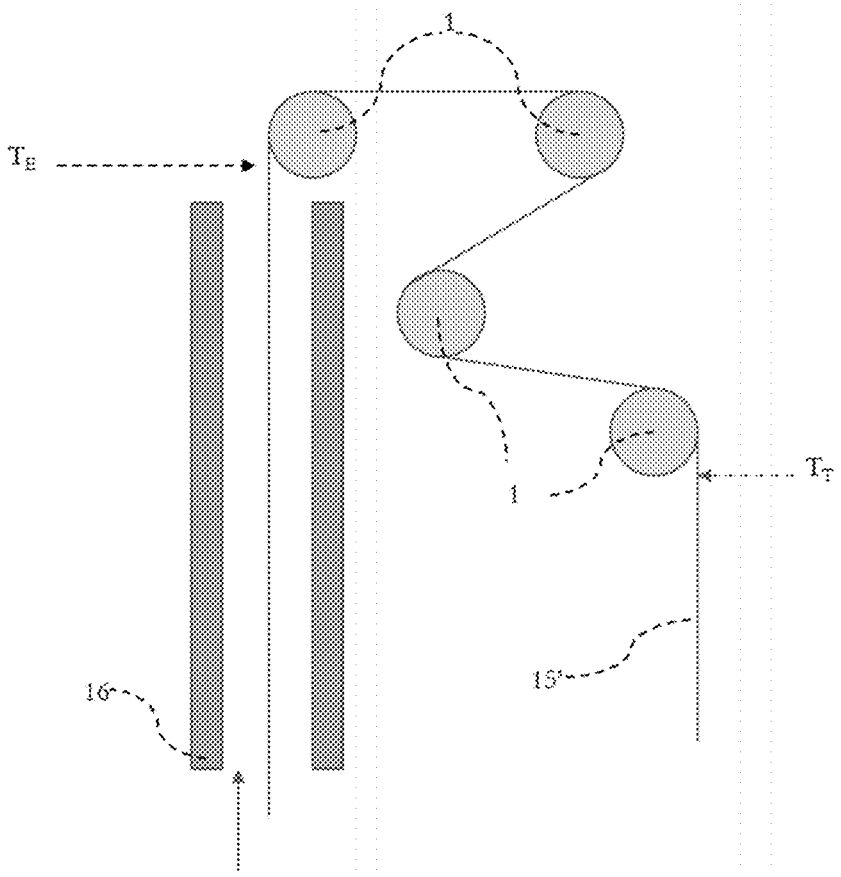
FIG. 9 exhibits a possible use of the cooling roll after a coating process.

As represented FIG. 9, in a coating line, at least a cooling roll 1 can be placed downstream a coating bath (not represented) and coolers 16 blowing air on each side of the strip 15'. Several cooling rolls 1 can be used depending on the strip speed, the entry and target temperatures of the strip, respectively $T_E$ and $T_T$ and the roll surface temperature. In this case, the strip is cooled from an entry temperature around 250° C. to a target temperature circa 100° C. when exiting the last cooling roll. As illustrated in FIG. 9, the rolls can be slightly shifted to the side where the strip contacts them to maximize the contact area between the rolls and the strip.

Figure 10:
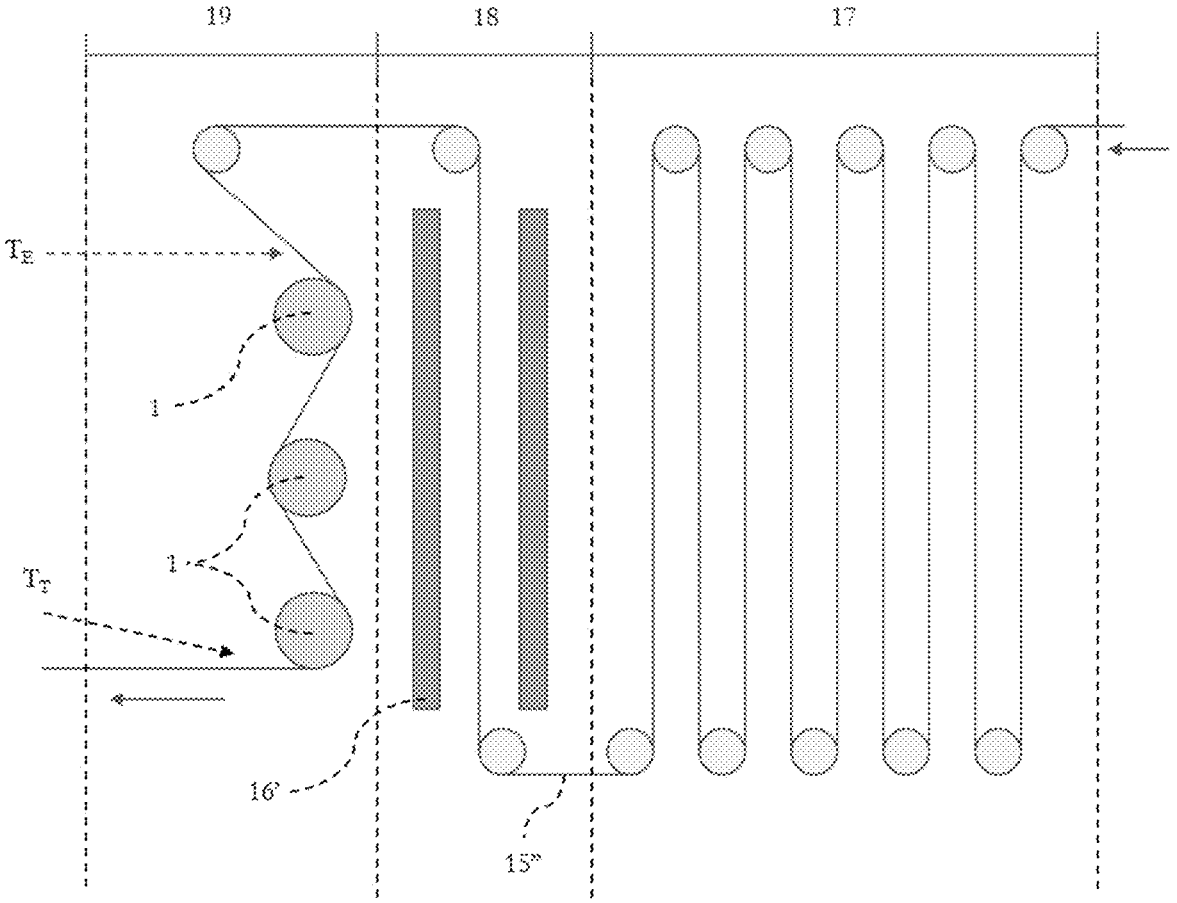
FIG. 10 exhibits a second possible use of the cooling roll in a finishing process.

As represented FIG. 10, in a finishing line, at least a cooling roll 1 can be used downstream a slow cooling zone 17 step, where the strip 15" is cooled by contacting the ambient air, and a rapid cooling zone 18, where coolers 16' blow air on each side of the strip. Usually, the strip enters the slow cooling zone 19 with a temperature circa 800° C. and then depending on the grades, the entry temperature, $T_E$, is between 400° C. and 700° C. just before contacting the first cooling roll and the target temperature, $T_T$, is circa 100° C.

Experimental Results

In order to assess the benefits of this invention and show that it reduces or at least it does not increase the temperature difference along the strip width, several results are showed and explained.

The experimental results have been obtained using the following roll and strip:

Roll dimensions and characteristics:

The inner cylinder is 1400 mm long and has a diameter of 800 mm made of carbon steel.

The magnets are composed of $Nd_2Fe_{14}B$ and disposed parallel to the roll rotation axis having a height of 30 mm and a width of 30 mm, separated by gaps of 2 mm disposed around and on the inner cylinder The cooling system is made of stainless steel. The cooling channels are disposed parallel to the axis of the roll. Moreover, the coolant is flowed in the cooling channels from their lateral sides. Injections of the coolant in said cooling channels are done at the opposite side of consecutive cooling channels permitting to have opposite coolant flow directions in adjacent cooling channels.

The gap height between the magnetic layer and the cooling system is of 10 mm.

The strip speed can be varied from 0.3 to 20 $m.s^{-1}$.

The strip is 1090 mm wide and made of steel.

Example 1

In order to verify that the temperature is more homogeneous after than before the cooling roll, the temperature difference between the temperature extremums along the strip width is compared before and after its cooling by the cooling roll.

If the difference between the hottest and the coldest point along the strip width is of 20° C. before the cooling roll and is of 10° C. after the cooling roll then the temperature gap difference is of 10° C. If the difference between the hottest and the coldest point along the strip width is of 20° C. before the roll and is of 30° C. after the roll then the temperature gap difference is of −10° C.

This means that the obtained temperature gap difference is superior to 0 then the temperature homogeneity along the strip width has been increased. Moreover, higher is the temperature gap difference value, better is the temperature homogeneity improvement.

Figure 11:
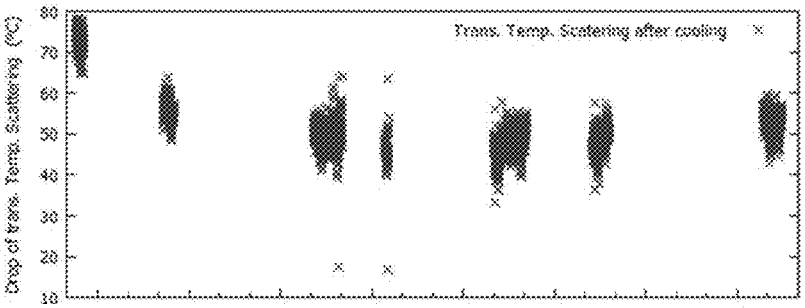
FIG. 11 comprises a graph showing the evolution of temperature discrepancy along the strip width.

It is clear from the reading of the graph, in FIG. 11, that the temperature homogeneity along the strip width is improved after the cooling. On the vertical axis are represented the values of the temperature gap difference, they are all above 0 and the vast majority is above 40° C. So, the temperature difference between the hottest and the coldest point of a strip width has been reduced by at least 40° C. in the vast majority of the cases. This result is a clear improvement compared to the results of the state of the art.

Example 2

Figure 12:
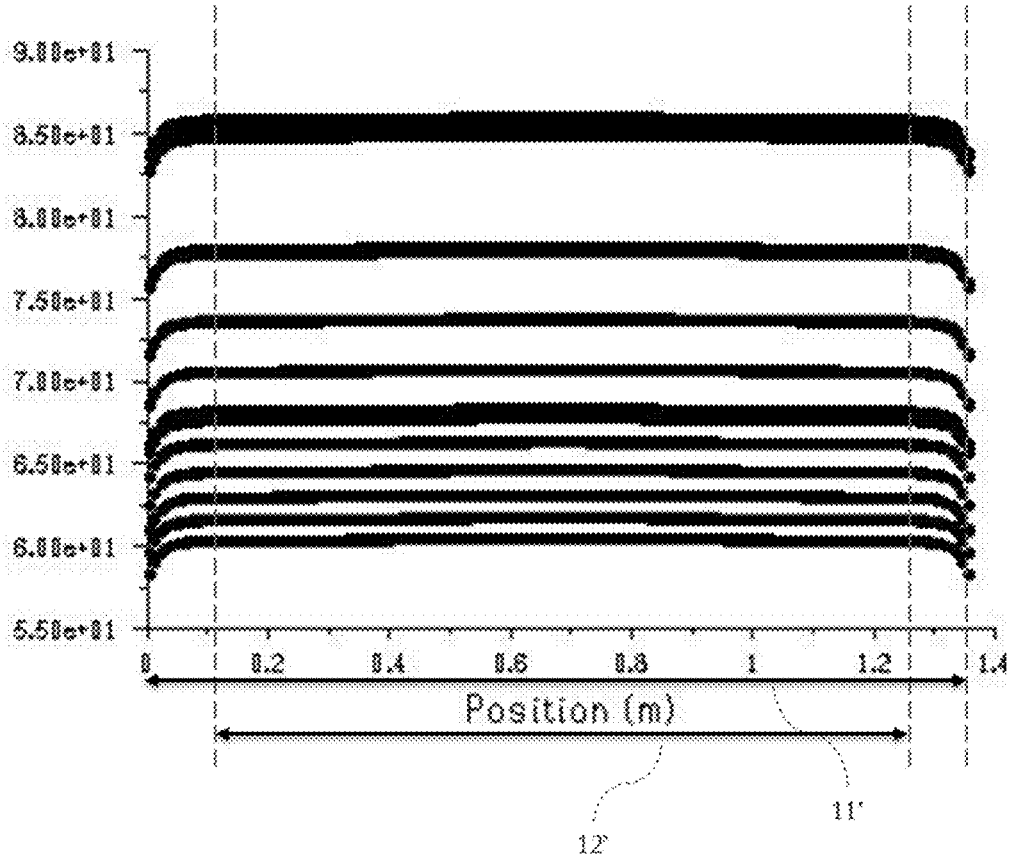
FIG. 12 exhibits the temperature of the roll surface along its width and a preferred position of the strip in view of the roll length.

In order to verify the improvement of the temperature homogeneity along the strip width, the roll temperature profiles along different width 11' has been measured, as it can be seen in FIG. 12. The temperature is uniform along the section in contact with the strip width 12'. Consequently, the strip is uniformly cooled in the width direction so the border and the center of the strip width are at the same temperature. This results clearly demonstrates the expected results of this invention and an improvement compared to the state of the art.

Example 3

In order to assess the ratio between the gap height and the magnet width, the attraction force generated by the magnets on the outer surface of the roll is determined in function of this ratio.

Figure 13:
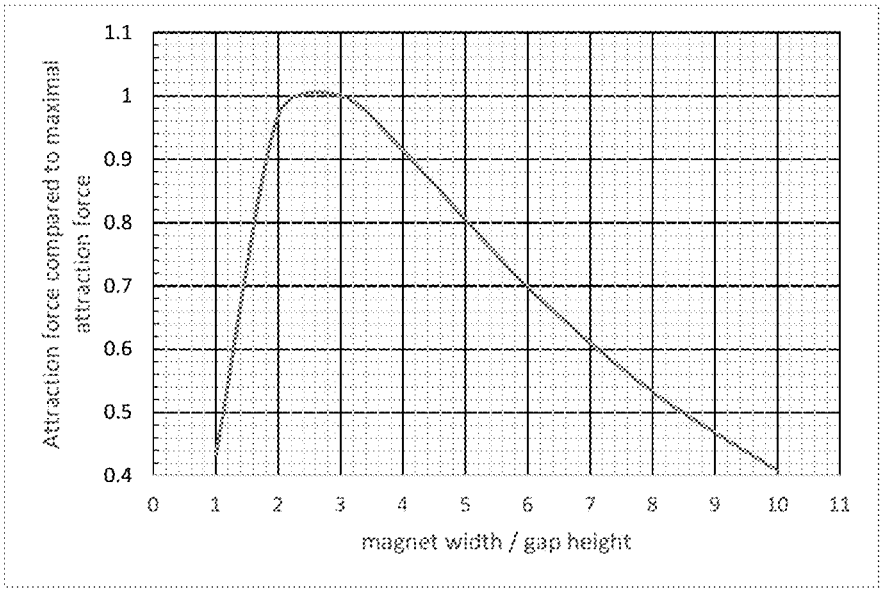
FIG. 13 shows the influence of the ratio between the magnet width and the gap height between the magnets and the cooling system.

From this graph, plotted in FIG. 13, it is clear that the optimal range is for a ratio following this equation:

gap height×1.1≤magnet width≤gap height×8.6, corresponding to approximately 50% of the maximum attraction force.

The invention claimed is:

1. A cooling roll comprising:

an axle; and a sleeve having a length in an axial direction, and defining a radial direction and a circumferential direction and a diameter, the sleeve including: from an inside to an outside:

an inner cylinder having a periphery and an inner cylinder length, a plurality of magnets on the periphery disposed along at least a portion of the inner cylinder length, each magnet being defined by a magnet width in the circumferential direction, a height in the radial direction and a length in the axial direction;

a cooling system surrounding at least a portion of said plurality of magnets;

the cooling system and the plurality of magnets being separated by a gap defined by a gap height in the radial direction, the gap height being a smallest distance between one of the plurality of magnets and the cooling system above, the magnet width of each of the magnets satisfying the following formula:

gap height×1.1≤magnet width≤gap height×8.6.

2. The cooling roll as recited in claim 1 wherein the magnets are permanent magnets.

3. The cooling roll as recited in claim 1 wherein the cooling system is made of a metallic part including at least two cooling channels, a coolant flowable through the at least two cooling channels.

4. The cooling roll as recited in claim 3 wherein the cooling channels are disposed parallel to a cooling roll height.

5. The cooling roll as recited in claim 3 wherein the cooling system includes at least one injector for injecting a coolant in the cooling channel.

6. The cooling roll as recited in claim 5 wherein the at least one injector for injecting a coolant includes a plurality of injectors disposed on both sides of the cooling channels.

7. The cooling roll as recited in claim 1 wherein the magnet width satisfies the following formula:

$$\text{gap height} \times 1.4 \leq \text{magnet width} \leq \text{gap height} \times 6.0.$$

8. The cooling roll as recited in claim 7 wherein said magnet width satisfies the following formula:

$$\text{gap height} \times 1.6 \leq \text{magnet width} \leq \text{gap height} \times 5.0.$$

9. The cooling roll as recited in claim 1 wherein the plurality of magnets is disposed along an entirety of the inner cylinder length.

10. The cooling roll as recited in claim 1 wherein the cooling system surrounds the plurality of magnets.

11. A method for cooling a continuously moving metallic strip, in an installation with at least one cooling roll as recited in claim 1, the method comprising:

attracting magnetically a portion of the metallic strip to the at least one cooling roll and putting the strip in contact with the at least one cooling roll.

12. The method as recited in claim 11 wherein the at least one cooling roll includes at least three cooling rolls and the strip is in contact with the at least three cooling rolls at a same time.

13. The method as recited in claim 11 wherein the strip in contact with the cooling roll has a speed between 0.3 $m.s^{-1}$ and 20 $m.s^{-1}$.

14. The method as recited in claim 11 wherein the cooling system is made of a metallic part including at least two cooling channels, a coolant flowable through the at least two cooling channels, and the method further comprises flowing the coolant in the cooling channels in opposite directions in adjacent cooling channels.

15. The cooling roll according to claim 1, wherein the cooling system has a hollow cylindrical shape.

16. The cooling roll according to claim 15, wherein the hollow cylindrical shape has one or more cooling channels therein.

17. The cooling roll according to claim 16, further comprising an injector and a return connected to each of the one or more cooling channels.

18. The cooling roll according to claim 16, wherein the one or more cooling channels are disposed parallel to the axle.

19. The cooling roll according to claim 15, wherein the hollow cylindrical shape has at least cooling channels therein, wherein each of the at least two cooling channels are disposed parallel to the axle and have a corresponding injector and return.

20. The cooling roll according to claim 6, wherein the plurality of injectors are disposed on both sides of the cooling channels alternatively, such that each adjacent injector of the plurality of injectors are arranged on opposite sides of the cooling channels.

* * * * *